US005580318A

United States Patent [19]

Weber

[11] Patent Number: 5,580,318

[45] Date of Patent: Dec. 3, 1996

[54] GOLF BALL DELIVERY SYSTEM

[76] Inventor: Robert E. Weber, 810 East C, Kingman, Kans. 67068

[21] Appl. No.: 593,197

[22] Filed: Jan. 29, 1996

[51] Int. Cl.[6] ..... A63B 57/00

[52] U.S. Cl. ..... 473/137; 473/132

[58] Field of Search ..... 473/132, 133, 473/134, 135, 136, 137; 221/186, 187, 188

[56] References Cited

U.S. PATENT DOCUMENTS

| | | | |
|---|---|---|---|
| 3,142,488 | 7/1964 | Portteus | 473/132 |
| 3,423,097 | 1/1969 | Fry | 473/136 |
| 4,817,955 | 4/1989 | Hickson et al. | 473/136 |
| 4,892,318 | 1/1990 | Jennings | 473/137 |
| 4,981,299 | 1/1991 | Petrillo | 473/137 |

*Primary Examiner*—Steven Wong

[57] ABSTRACT

A golf ball delivery system includes a tee holder adapted to support a golf ball tee upon the ground and a golf ball dispenser coupled with the tee holder. The golf ball dispenser includes a container for holding a plurality of golf balls, a support rotatably supporting the container horizontally above the ground and a delivery chute rigidly attached to the container and defining a golf ball transporting passage. The container has first and second ends and an outlet hole in the first end. The first end of the container is disposed closer to the ground than the second end such that golf balls within the container gravitate toward the first end. The delivery chute has a golf ball receiving end rigidly attached to the first end of the container with the passage in communication with the outlet hole and has a golf ball delivering end. The delivery chute is adapted to be engaged by the head of a golf club to manually move the delivery chute to rotate the container between a first rotational position wherein the outlet hole is positioned such that a golf ball within the container enters the passage of the delivery chute by gravity and a second rotational position wherein the golf ball delivering end is positioned below the golf ball receiving end such that the golf ball within the passage is delivered onto the golf ball tee by gravity from the golf ball delivering end of the delivery chute.

20 Claims, 4 Drawing Sheets

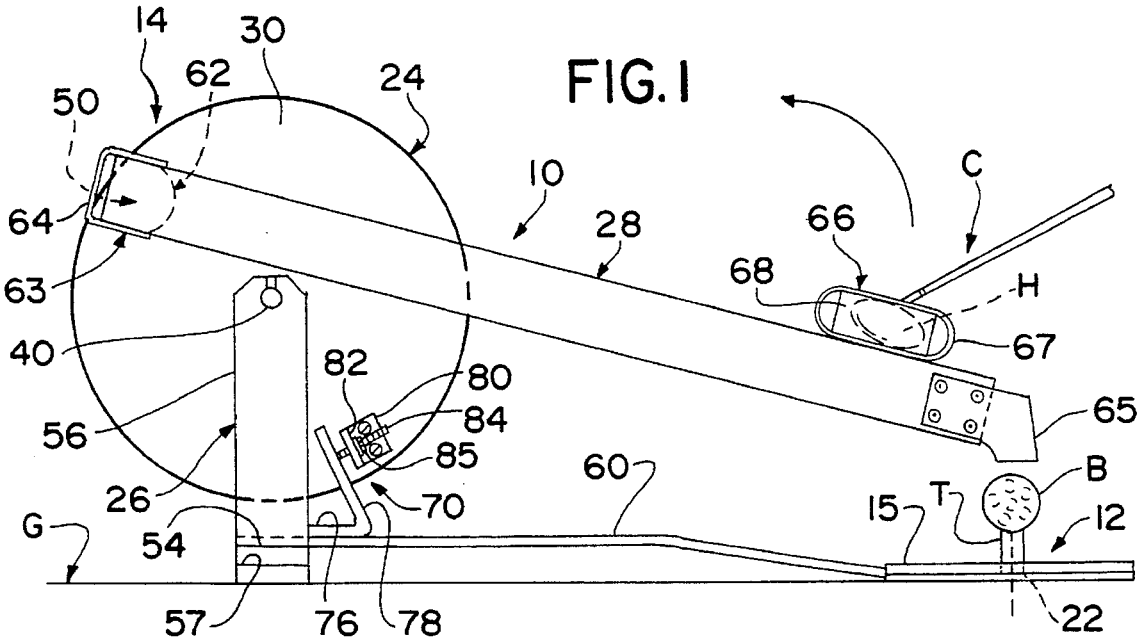
FIG.1
14
30
62
24
50
10
C
64
28
66
63
68
H
67
40
82
80
84
65
56
85
60
B
26
70
15
T
12
G
54
57
76
78
22
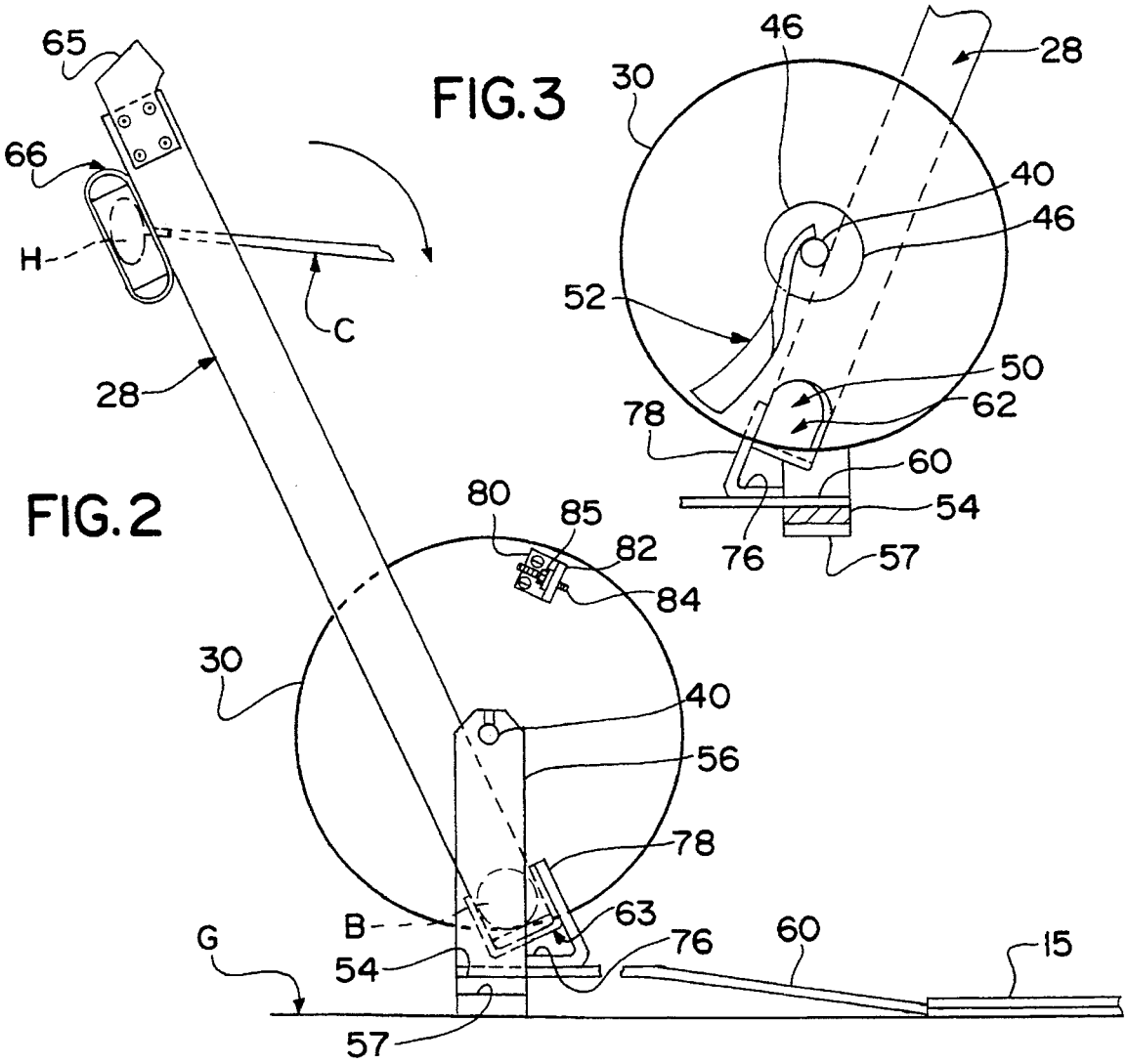
FIG.3
46
28
30
65
40
46
66
H
52
C
50
62
28
78
60
54
FIG.2
80
85
82
76
57
84
30
40
56
78
B
63
G
76
60
15
54
57

GOLF BALL DELIVERY SYSTEM

BACKGROUND OF THE INVENTION

1. Field of the Invention

The present invention relates generally to golf ball delivery apparatus and, more particularly, to apparatus and systems for setting or delivering golf balls onto a golf ball tee.

2. Brief Description of the Prior Art

Golf driving ranges have become extremely popular for use by golfers to practice golf swings in order to improve accuracy, distance and proficiency as well as to correct problems in the golf swing. Typical driving ranges sell buckets of golf balls to be utilized by the golfers for practice. After each practice drive or swing, the golfer must bend over to pick up a new golf ball from the bucket and place the new golf ball on a golf ball tee in preparation for the next practice swing. Repeated bending by the golfer can cause injury and strain in the legs and back and is particularly problematic for golfers with existing back problems. In addition, the amount of time available for practice is reduced due to the time required to "tee up" for each practice swing.

Various apparatus for delivering golf balls automatically or on demand to a golf ball tee have been proposed. Representative of prior art golf ball delivery apparatus are U.S. Pat. No. 5,326,107 to Park, U.S. Pat. No. 5,282,628 to Kamori et al, U.S. Pat. No. 5,259,622 to Irving, U.S. Pat. No. 5,131,661 to Jorgensen, U.S. Pat. No. 4,995,614 to Tange, U.S. Pat. No. 4,892,318 to Jennings, U.S. Pat. No. 4,817,955 to Hickson et al, U.S. Pat. No. 4,796,893 to Choi, U.S. Pat. No. 4,265,453 to Loof, U.S. Pat. No. 3,003,770 to Jones, U.S. Pat. No. 2,171,299 to Beckett, U.S. Pat. No. 2,071,356 and U.S. Pat. No. 1,940,321 to Pagett, U.S. Pat. No. 348,497 to Tange and U.S. Pat. No. 345,665 to Luther. Prior art golf ball delivery apparatus have various disadvantages including complexity of structure, construction and/or operation, the inability to be easily transported, the inability to be used away from a commercial driving range, adverse impact on the golfer's swing, inconvenient operating procedures or protocols disliked by golfers, high installation, maintenance and operating costs, susceptibility to major damage when accidentally hit by a golfer, the tendency for golf balls to bind or jam and the failure of golf balls to be accurately, consistently delivered to a golf ball tee.

SUMMARY OF THE INVENTION

Accordingly, it is a primary object of the present invention to overcome the foregoing disadvantages of prior art golf ball delivery apparatus.

Another object of the present invention is to manually move a delivery chute of a golf ball delivery system to rotate a container containing a plurality of golf balls whereby a single golf ball in the container is caused to enter the delivery chute by gravity and is delivered by gravity from the delivery chute onto a golf ball tee.

It is a further object of the present invention to rotate a container of a golf ball delivery system between a first rotational position wherein an outlet hole of the container is disposed below a level of golf balls in the container such that a golf ball in the container is caused to enter a delivery chute by gravity and a second rotational position wherein the outlet hole is disposed above the level of golf balls in the container and the delivery chute is positioned to deliver the golf ball therein by gravity onto a golf ball tee.

An additional object of the present invention is to provide a golf ball delivery system including a container rotatably mounted horizontally above the ground and having first and second ends with the first end disposed closer to the ground than the second end such that golf balls within the container gravitate toward the first end and a delivery chute movable between a golf ball receiving position wherein the container is rotated to cause a single golf ball therein to enter the delivery chute and a golf ball delivering position wherein the delivery chute is positioned to deliver the golf ball onto a golf ball tee by gravity.

The present invention has as a further object to limit rotation of the container in the first and second rotational positions to position the delivery chute to receive and to deliver golf ball, respectively.

The present invention has as another object to direct a single golf ball to enter the delivery chute from the container without jamming or binding.

Some of the advantages of the present invention are that a golfer can devote a greater amount of time to practice by eliminating the wasted time required to "tee up" for each shot, golfer fatigue, strain and injury are greatly reduced, the golf ball delivery system according to the present invention is easy to operate and is readily transportable, the golf ball delivery system is structurally uncomplicated and can be made of readily available materials and components, the golf ball delivery system can be used with conventional golf ball tees and encourages periodic inspection of golf ball tees, and the golf ball delivery system can be used by right and left-handed golfers.

These and other objects, advantages and benefits are realized with the present invention as characterized in a golf ball delivery system comprising a tee holder for being supported on the ground and being adapted to hold a golf ball tee and a golf ball dispenser or setter coupled with the tee holder for delivering a golf ball onto the golf ball tee. The golf ball dispenser includes a container for holding a plurality of golf balls, a support for rotatably supporting the container horizontally above the ground and a delivery chute rigidly attached to the container and defining a golf ball transporting passage. The container includes first and second ends and an outlet hole in the first end for receiving a single golf ball. The first end of the container is disposed closer to the ground than the second end of the container such that golf balls in the container are urged by gravity toward the first end. The delivery chute has a golf ball receiving end rigidly attached to the first end of the container with the passage of the delivery chute communicating with the outlet hole and has an open, golf ball delivering end extending beyond the container. The delivery chute is adapted to be engaged by the head of a golf club to move the delivery chute to rotate the container between a first rotational position wherein the outlet hole and the golf ball receiving end of the delivery chute are positioned such that a single golf ball in the container passes through the outlet hole into the passage of the delivery chute by gravity and a second rotational position wherein the outlet hole and the golf ball receiving end of the delivery chute are positioned such that another golf ball cannot enter the delivery chute and the golf ball delivering end of the delivery chute is disposed below the golf ball receiving end and is aligned with the golf ball tee such that the golf ball in the passage is delivered by gravity onto the golf ball tee from the golf ball delivering end of the delivery chute.

Other objects and advantages of the present invention will become apparent from the following description of the preferred embodiments taken in conjunction with the accompanying drawings wherein like parts in each of the several figures are identified by the same reference characters.

BRIEF DESCRIPTION OF THE DRAWINGS

FIG. 1 is a side view of the golf ball delivering system according to the present invention showing the delivery chute in the golf ball delivering position.

FIG. 2 is a broken side view of the golf ball delivery system showing the delivery chute in the golf ball receiving position.

FIG. 3 is a broken side view of the golf ball delivery system showing an agitator in the container of the golf ball dispenser.

DESCRIPTION OF THE PREFERRED EMBODIMENTS

Figure 4:
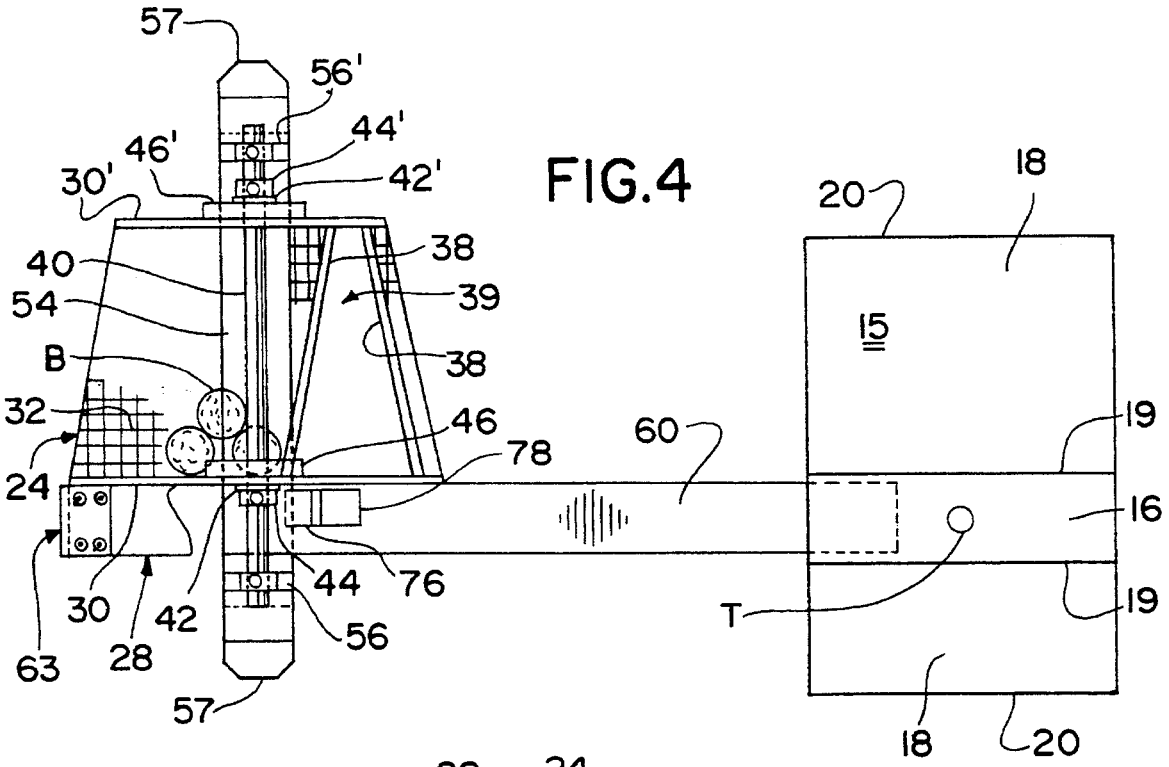
FIG. 4 is a top plan view of the golf ball delivery system.

A golf ball delivery system 10 according to the present invention is illustrated in FIG. 1 and includes a tee holder 12 adapted to support, mount or hold a golf ball tee and a golf ball dispenser or setter 14 coupled with tee holder 12 for delivering or setting a golf ball onto the golf ball tee. As best shown in FIGS. 1 and 4, the tee holder 12 includes a rectangular plate 15 of uniform thickness and having a middle section 16 and side sections 18 flanking middle section 16. Side sections 18 are bent or angled slightly from middle section 16 along opposing, parallel junction lines 19 extending transverse or perpendicular to a central major axis of tee holder 12. End edges 20 of tee holder 12 disposed parallel to junction lines 19 allow the tee holder to be supported on the ground G or other support surface with the middle section 16 spaced slightly above the ground G due to the angle of side sections 18. Middle section 16 is offset from a central minor axis of the tee holder 12 such that the distance from the junction line 19 to the end edge 20 of one side section 18 is less than the corresponding distance for the other side section 18. A hole or recess 22, shown in dotted lines in FIG. 1, is formed in the center of the middle section 16 along the central major axis of the tee holder 12 for receiving, mounting, holding or supporting a golf ball tee T. Golf ball tee T is preferably made of a length of rubber tubing pressed into hole 22. It should be appreciated, however, that the golf ball tee T can be made of various materials and can have various configurations including various conventional golf ball tees. For example, the golf ball tee can include a base portion and a tee portion in which case the base portion can be disposed beneath middle section 16 with the tee portion protruding from hole 22 to extend beyond plate 15. The tee holder 12 can be made of any suitable material such as a corrosion resistant metal. Preferably, the tee holder is made from a metal plate 13 inches long by 9 inches wide by ⅛ inch thick. The end edge 20 of the shorter side section 18 is preferably located 5 inches from the center line of hole 22. Preferably, at least an upper surface of the tee holder 12 is covered with a layer or mat of artificial turf material to resemble grass and to protect the golfer's golf club heads.

Golf ball dispenser or setter 14 includes a container, bucket or drum 24 for holding a supply of golf balls B, a support 26 mounting container 24 and a delivery chute 28 attached to container 24 for delivering or setting a golf ball B onto tee T. Container 24 has first and second ends, a pair of spaced, circular end members or plates 30 and 30' at the first and second ends, respectively, and a screen or mesh 32 connected between end plates 30 and 30' to form a hollow enclosure or cage for holding golf balls B. Container 24 has a tapered or truncated conical external configuration with a circular cross-section of diminishing size between end plates 30 and 30'; and, accordingly, end plate 30 has an external diameter greater than the external diameter of end plate 30'. The end plates can be made of any suitable corrosion resistant material and preferably are made from aluminum. According to a preferred embodiment, end plate 30 has a diameter of 11 inches and a thickness of 3/16 inch and end plate 30' has a diameter of 8 inches and a thickness of 3/16 inch. Screen 32 is preferably made of a corrosion resistant metallic mesh or screen material sufficiently fine to prevent the passage of golf balls B therethrough. The screen 32 can be attached to the end plates 30 and 30' in many various ways. For example, a metal band or strip can be attached to opposing side edges of the screen material, and the opposing side edges of the screen material can be attached to the peripheral or circumferential edges of end plates 30 and 30', respectively, with the use of securing elements, such as screws, passing through the bands and into the end plates. With the screen 32 attached to the end plates 30 and 30', end edges 38 of the screen are spaced from one another to define an opening or window 39 in container 24 through which a plurality of golf balls B can be positioned in and removed from the interior of the container. Each end plate has a hole or aperture in the center thereof receiving or mounting a shaft 40 extending longitudinally through container 24 with opposing ends of the shaft protruding beyond the end plates. Shaft 40 is preferably made of non-corrosive metal; and, according to a preferred embodiment, shaft 40 is 13 and ¾ inches long.

Container 24 is rotatably mounted on shaft 40 with end plates 30 and 30' mounted between bushings 42 and 42', respectively, through which shaft 40 extends. Bushings 42 and 42' are preferably headed bronze bushings and are held in place by set collars 44 and 44', respectively, receiving shaft 40. Each bushing is disposed between a set collar and an annular hub having an aperture therein through which shaft 40 extends. Hub 46 for bushing 42 is disposed within container 24 adjacent an internal surface of end plate 30 while hub 46' for bushing 42' is disposed on the outside of container 24 adjacent an external surface of end plate 30'. The hubs 46 and 46' can be secured to the end plates 30 and 30', respectively, such as with screws passing through the hubs and into the end plates. The set collars 44 and 44' are rigidly secured to shaft 40 to prevent longitudinal movement of container 24 along shaft 40 while permitting container 24 to rotate about a central longitudinal axis thereof aligned with or defined by shaft 40. The set collars can be secured to the shaft in many various ways including with the use of screws passing through the set collars and into shaft 40. An outlet hole 50, shown in FIGS. 1 and 3, is formed in end plate 30 as a partial oblong shaped notch or cutout along the circumference or periphery of end plate 30, the outlet hole 50 being sufficiently large to allow a single golf ball to pass therethrough. An agitating member 52 is disposed in container 24 and includes a strip or bar of suitable material, such as corrosion resistant metal, having a first end rigidly connected to shaft 40 adjacent hub 46 and a second, free or unattached end rotated, twisted or bent 90° from the first end and extending toward outlet hole 50. The second end of the agitating bar is disposed close to the outlet hole 50 but does not block or obstruct the outlet hole when the delivery chute is in a golf ball receiving position as explained further below.

Figure 5:
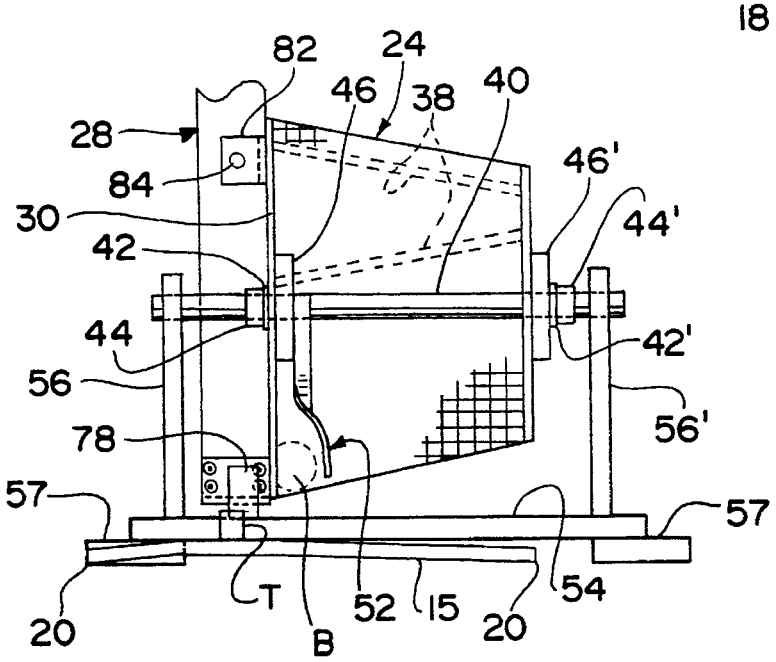
FIG. 5 is a broken front view of the golf ball delivery system showing the delivery chute in the golf ball receiving position.

Support 26, as best shown in FIG. 5, includes a base 54 and spaced, parallel uprights 56 and 56' extending perpendicularly from base 54. Support 26 is preferably made from a durable, non-corrosive metal, such as steel. Base 54 is preferably an elongate flat member of uniform thickness having opposing ends supported on pads or feet 57 adapted to rest or be supported on the ground G or other support surface. With support 26 supported on ground G via pads 57, base 54 is spaced from or disposed above the ground G a distance greater than the distance that the middle section 16 of tee holder 12 is disposed above or spaced from ground G. Uprights 56 and 56' are preferably elongate flat members of uniform thickness having lower ends secured to base 54 and chamfered upper ends with holes therein receiving shaft 40. The uprights 56 and 56' can be secured to base 54 in many various ways, including welding and the use of securing devices such as screws or rivets. The holes at the upper ends of the uprights 56 and 56' are longitudinally aligned with one another and are located the same distance from base 54 to receive the opposing ends of shaft 40. The ends of shaft 40 are rigidly secured to the uprights 56 and 56', such as with screws passing through the upper ends of the uprights and into shaft 40. Accordingly, support 26 rotatably mounts container 24 horizontally above the ground, and the first end of container 24 will be disposed closer to the ground than the second end thereof such that golf balls in the container gravitate toward the first end.

A connecting arm 60 couples the golf ball dispenser 14 with the tee holder 12 and has a first end secured to base 54 and a second end secured to tee holder 12. Preferably, the connecting arm 60 is an elongate strip of non-corrosive metallic material having a straight portion extending from base 54 parallel therewith and an angled portion extending angularly downwardly from the straight portion to tee holder 12. As shown in FIGS. 1 and 4, the straight portion of the connecting arm rests upon and is secured to an upper surface of base 54, and the angled portion of the connecting arm is disposed beneath the middle section 16 of the tee holder and is connected thereto. The connecting arm is located between the external surface of end plate 30 and an inner surface of the corresponding upright 56; and, as shown in FIG. 3, the connecting arm 60 is connected to base 54 adjacent the external surface of the end plate 30. The connecting arm can be secured to the golf ball dispenser and to the tee holder in many various ways, such as by welding or with the use of securing devices such as screws or rivets. If desired, the connecting arm can be releasably attached to the golf ball dispenser and/or the tee holder to allow the golf ball dispenser and the tee holder to be detached from one another or disassembled to facilitate storage.

Delivery chute 28 defines a golf ball transporting passage and includes a first or golf ball receiving end and an open, second or golf ball delivering end. The golf ball receiving end has an aperture, notch or cutout 62 formed in a side wall thereof, the aperture 62 being large enough to receive a single golf ball. Delivery chute 28 is rigidly attached or secured to container 24 with the side wall of the chute member containing aperture 62 in abutment with the external surface of end plate 30 and with aperture 62 in alignment with the outlet hole 50. Securing elements, such as screws passing through the delivery chute and the end plate, can be utilized to rigidly secure the golf ball receiving end of the delivery chute along the external surface of end plate 30; however, the delivery chute can be secured to the end plate in many various ways. Delivery chute 28 is made from an elongate, hollow chute member having a square configuration in cross-section and opposing first and second open ends. An end cap 63 is disposed on the first end of the chute member and includes a leather strap bent to define a U-shape and having opposite ends pop-riveted to opposing side walls of the chute member perpendicular to end plate 30. An end wall 64 of the end cap is spaced slightly from the first end of the chute member such that a golf ball drops into the golf ball receiving end of the delivery chute when the delivery chute is moved to the golf ball receiving position as explained below. It should be appreciated, however, that the chute member itself can be designed with an end wall such that a separate end cap need not be required and; where provided, the end cap can be designed in many various ways and of many diverse materials. The second end of the chute member carries or forms a deflector 65 at the golf ball delivering end of the delivery chute for deflecting, guiding or directing a golf ball onto tee T. Deflector 65 for golf ball dispenser 14 includes a piece of leather having opposing ends pop-riveted to opposing sides of the chute member parallel with the external surface of end plate 30 and a protruding or depending portion extending toward tee T. The deflector 65 defines a continuation of the chute member passage at the golf ball delivering end of the delivery chute with the depending portion serving as a guide for guiding or directing a golf ball onto the golf ball tee T when the delivery chute is in a golf ball delivering position as explained below. It should be appreciated that the chute member can itself be configured to direct, guide or deflect a golf ball onto the golf ball tee such that a separate deflector need not be required; and, where provided, the deflector can be designed in many various ways and can be made of various diverse materials. The delivery chute 28 is secured to the container 24 non-perpendicularly to shaft 40 and has a length such that the golf ball delivering end is vertically aligned with tee T when the delivery chute is in the golf ball delivering position as shown in FIG. 1. According to a preferred embodiment, the chute member is 26 and ½ inches long and 2 inches by 2 inches in cross-section. A golf club pocket 66 is carried by the delivery chute 28 and includes a curving side wall 67 circumscribing an oval pocket open on one side thereof and closed on an opposite side thereof by an end wall 68. The side wall 67 is secured to a side wall of the delivery chute perpendicular to end plate 30 with the delivery chute being disposed between the pocket 66 and the ground G when the delivery chute is in the golf ball delivering position. The golf club pocket 66 is arranged on delivery chute 28 with the open side of the pocket on the same side of delivery chute 28 as container 24. The golf club pocket 66 can be made of any suitable material such as plastic or leather. In the case of golf ball setter 14, the golf club pocket is made of leather and is pop-riveted to the side wall of the delivery chute. The golf club pocket 66 has a size and configuration to receive a head of a golf club inserted through the open side of the pocket.

An adjustable stop mechanism 70 limits or controls rotation of container 24 about shaft 40 to properly position the outlet hole 50 and the golf ball receiving end of the delivery chute 28 to receive a single golf ball when the delivery chute is in the golf ball receiving or up position and to deliver the golf ball onto the golf ball tee T when the delivery chute is in the golf ball delivering, setting, dispensing or down position. Stop mechanism 70 includes an abutment member secured to connecting arm 60 and a stop member carried by container 24. Abutment member includes a flat base 76 secured on an upper surface of connecting arm 60 and a leg 78 extending from base 76 at an acute angle therewith. The abutment member is located between the external surface of end plate 30 and the corresponding upright 56 with the leg 78 being disposed slightly forwardly of the upright 56 and being angled from base 76 in the direction of upright 56. With the abutment member thusly secured to connecting arm 60, leg 78 is disposed perpendicular to and adjacent the external surface of end plate 30. The abutment member can be secured to the connecting arm 60 in many various ways including screws, rivets and welding. The stop member includes a flat base 80 secured, such as with screws, on the external surface of end plate 30 and a leg 82 extending perpendicularly from base 80. Leg 82 has a hole therein receiving an externally threaded, elongate spacer 84 threadedly inserted through an internally threaded nut 85. The stop member is secured to end plate 30 adjacent the circumference thereof such that leg 82 and/or spacer 84 engages leg 78 to limit clockwise rotation of container 24 about shaft 40 in the golf ball delivering or down position for delivery chute 28 as shown in FIG. 1. Engagement of leg 82 with leg 78, in which case the spacer 84 does not protrude beyond leg 82, allows maximum clockwise rotation of container 24 about shaft 40. The extent to which container 24 is permitted to rotate clockwise about shaft 40 can be adjusted with spacer 84 to obtain less than the maximum clockwise rotation. For example, the spacer 84 can be threadedly advanced to protrude from leg 82 a desired amount such that the protruding tip of spacer 84 will engage leg 78 when the container is rotated clockwise as shown in FIG. 1. With the use of adjustable stop mechanism 70, the extent to which the container 24 is allowed to rotate clockwise in the down position for delivery chute 28 can be selected to obtain proper alignment and/or spacing of the golf ball delivering end with tee T as explained further below. When the delivery chute 28 is moved or rotated counterclockwise from the golf ball delivering position to the golf ball receiving or up position as shown in FIG. 2, the delivery chute will abut leg 78 to limit counterclockwise rotation of container 24 about shaft 40. Accordingly, the outlet hole 50 and the aperture 62 of the delivery chute will be optimally positioned to cause a single golf ball B within container 24 to pass through the outlet hole 50 and into the passage of the delivery chute 28 by gravity as explained further below.

In use, the golf ball delivery system 10 is placed upon the ground G or other support surface with the delivery chute 28 in either the golf ball delivering position as shown in FIG. 1 or the golf ball receiving position as shown in FIG. 2. A plurality of golf balls B are placed in container 24 via the window 39. The amount of golf balls supplied to container 24 is selected such that the level of golf balls is disposed below outlet hole 50 when the delivery chute 28 is in the golf ball delivering position and such that the golf balls do not fall out of the container through the window 39 during use. Typically, the container is no more than half filled with golf balls. The golf ball delivery system 10 will be supported or stabilized relative to the ground G due to three triangularly arranged areas of contact between the golf ball delivery system and the ground G, i.e. first and second areas of contact defined by pads 57 and a third area of contact defined by tee holder end edges 20. In the case of golf ball delivery system 10, the uprights 56 will be disposed perpendicular to the ground with the longitudinal axis of container 24 perpendicular to uprights 56 and parallel to the ground G. If the delivery chute 28 is in the golf ball delivering position, clockwise rotation of container 24 is limited by adjustable stop mechanism 70 such that the golf balls B within container 24 cannot fall out through window 39 and the deflector 65 at the golf ball delivering end of the delivery chute will be vertically aligned with and just above golf ball tee T. Outlet hole 50 of end plate 30 and aperture 62 of delivery chute 28 aligned therewith are disposed higher than or above the golf ball delivering end such that the delivery chute extends angularly downwardly from the golf ball receiving end to the golf ball delivering end. Accordingly, outlet hole 50 and aperture 62 are disposed at an upper end of container 24 and are disposed higher than or above shaft 40 and the level of golf balls in the container. Since the golf balls B within container 24 gravitate toward a lower end of container 24 at end plate 30, the golf balls B cannot enter the delivery chute through the outlet hole 50 when the delivery chute is in the golf ball delivering position. In order to deliver a golf ball onto the golf ball tee T, the golfer stands facing the container 24 with the tee T disposed between the container 24 and the golfer. The golfer extends a golf club C toward the golf ball delivery system and inserts the head H of the golf club in the golf club pocket 66. The golfer moves the golf club upwardly and in the direction of container 24 to manually lift, move, pivot or rotate delivery chute 28 counterclockwise as shown by the arrow in FIG. 1 causing container 24 to rotate counterclockwise about shaft 40. The delivery chute 28 is thusly rotated counterclockwise from the golf ball delivering position shown in FIG. 1 to the golf ball receiving or up position shown in FIG. 2. In the golf ball receiving position, the deflector 65 and, therefore, the golf ball delivering end of the delivery chute, is disposed higher than or above the golf ball receiving end, and container 24 will be in a first rotational position with outlet hole 50 disposed at a lowermost end of container 24 below shaft 40 and below the level of golf balls. The golf balls B within container 24 are urged by gravity toward the end plate 30 and the lower end of the container; and, since outlet hole 50 and aperture 62 are now at the lower end of the container, a single golf ball B will pass through the outlet hole 50 and the aperture 62 into the passage of the delivery chute 28. When the delivery chute is moved from the golf ball delivering position to the golf ball receiving position, the agitating member 52 agitates or stirs the golf balls within the container such that a single golf ball enters the outlet hole 50 without jamming, binding, bridging or clogging. Counterclockwise rotation of delivery chute 28 and, therefore, container 24, is limited due to abutment of the delivery chute with leg 78 as shown in FIG. 2 to insure proper positioning of outlet hole 50 and aperture 62 to receive a golf ball. Once a golf ball has entered the delivery chute, the golfer moves the golf club C having its head H engaged in pocket 66 downwardly and in a direction away from container 24 and toward the golfer as shown by the arrow in FIG. 2. Accordingly, the delivery chute 28 is manually moved, pivoted or rotated clockwise from the golf ball receiving position to the golf ball dispensing position. Movement of delivery chute 28 from the golf ball receiving position to the golf ball dispensing position causes clockwise rotation of container 24 to a second rotational position, and the deflector 65 at the golf ball delivering end of the delivery chute will be vertically aligned with and disposed just above tee T. Accordingly, when the delivery chute is rotated from the golf ball receiving position to the golf ball dispensing position, the golf ball delivering end of the delivery chute will be moved to a position below or lower than the golf ball receiving end, i.e. closer to the ground than the golf ball receiving end, such that the golf ball in the passage of the delivery chute will be transported by gravity from the golf ball receiving end to the golf ball delivering end of the delivery chute and will be delivered or dropped by gravity onto tee T. The delivery chute 28 is then moved from the golf ball delivering position to the golf ball receiving position to receive another golf ball allowing the golf ball delivered onto tee T to be hit by the golfer. To deliver another golf ball onto the tee, the delivery chute 28 is manually moved from the golf ball receiving position to the golf ball delivering position causing the golf ball that has already entered the delivery chute to be dispensed or set onto the golf ball tee T. Once all of the golf balls in container 24 have been delivered, new supply of golf balls can be introduced into the container via the window 39. The golf ball delivery system is easily transported or carried and can be transported within the trunk of a car. To carry the golf ball delivery system, the delivery chute is moved to the golf ball delivering position and one hand is introduced in container 24 via window 39 to grasp shaft 40 while the other hand is used to grasp the connecting arm 60.

Figure 6:
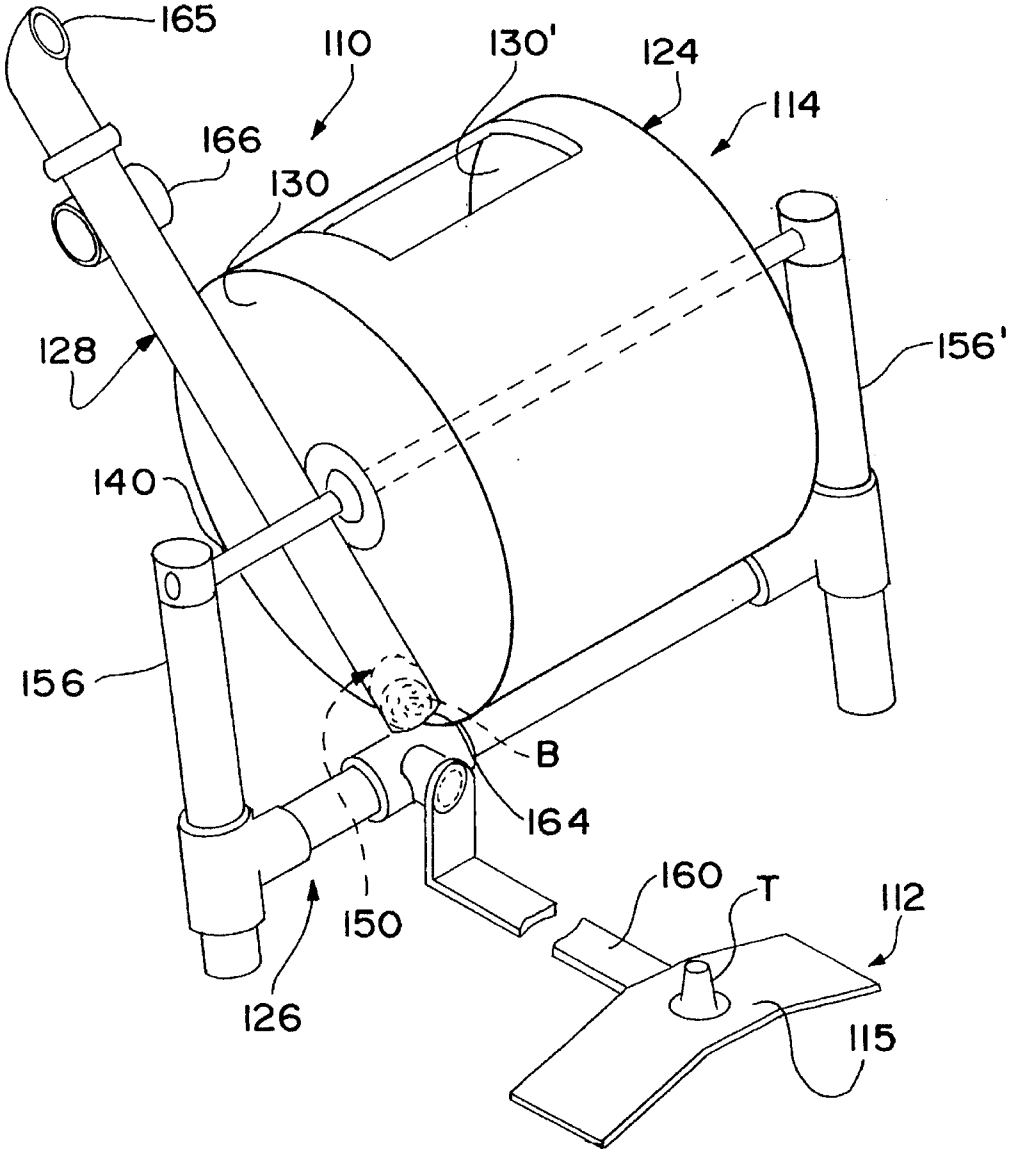
FIG. 6 is a broken perspective view of an alternative embodiment of the golf ball delivery system according to the present invention showing the delivery chute in the golf ball receiving position.
Figure 7:
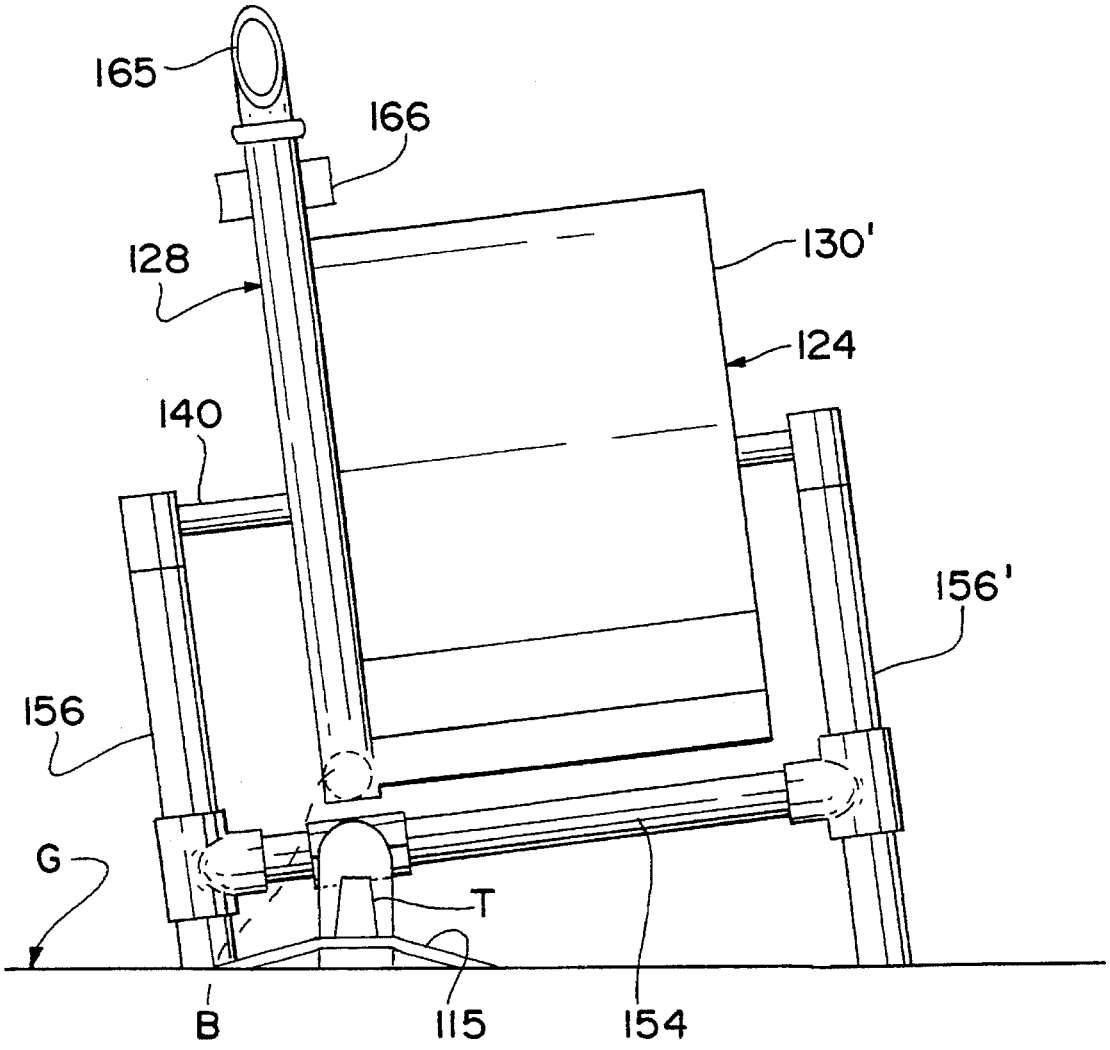
FIG. 7 is a front view of the golf ball delivery system of FIG. 6 showing the delivery chute in the golf ball receiving position.

An alternative embodiment of a golf ball delivery system according to the present invention is illustrated at 110 in FIGS. 6 and 7. Golf ball delivery system 110 is substantially the same as golf ball delivery system 10 except that golf ball delivery system 110 is primarily made of interconnected tubular members and fittings of polyvinylchloride and includes a tilt-mounted container having a straight cylindrical configuration. Golf ball dispenser 114 for golf ball delivery system 110 includes container 124, support 126 and delivery chute 128. Container 124 is similar to container 24 except that container 124 has a straight cylindrical configuration between circular end members 130 and 130' and is fabricated from a polyvinylchoride pipe or tube. Support 126 includes a base 154 and spaced, parallel uprights 156 and 156' extending perpendicularly from base 154. Base 154 is made from a tubular piece of polyvinylchloride held by and between opposed T-shaped fittings of polyvinylchloride. Uprights 156 and 156' are made as tubular pieces of polyvinylchloride having lower ends received in the T-shaped fittings of base 154 and upper ends rigidly receiving opposing ends of shaft 140 around which container 124 is rotatable. The lower ends of the uprights 156 and 156' protrude from the T-shaped fittings of base 154 to terminate at lower edges or surfaces that are cut at an angle allowing the uprights to be supported upon the ground G via the lower edges or surfaces thereof with container 124 tilted or at an angle. As shown in FIG. 7, with the support 126 supported on ground via the lower edges of the uprights 156 and 156', the uprights will be disposed non-perpendicularly or at an acute angle with the ground G such that shaft 140 and, therefore, the longitudinal axis of container 124, is angularly offset approximately 4 degrees from being parallel with the ground G. Accordingly, container 124 is rotatably supported horizontally above the ground with the first end thereof disposed lower than the second end thereof such that golf balls within the container gravitate toward the first end. Delivery chute 128 is similar to delivery chute 28 except that delivery chute 128 is fabricated from a length of polyvinylchloride tubing having a golf ball receiving end rigidly attached to container 124 with the golf ball transporting passage in communication with outlet hole 150 and having a golf ball delivering end defined by a polyvinylchloride elbow member defining a deflector 165. The golf ball receiving end of the delivery chute has an end wall 164 disposed beyond the circumference or periphery of end member 130. Delivery chute 128 carries a pocket 166 formed of a length of polyvinylchloride tubing disposed transverse or perpendicular to the length of the delivery chute. Tee holder 112, which is the same as tee holder 12, is coupled with the golf ball dispenser 114 by a connecting arm 160 made of a bent iron strap having a first end secured to a polyvinylchloride T-shaped fitting disposed over base 54 and a second end connected to the plate 115. The golf ball delivery system 110 can have an adjustable stop mechanism (not shown) for limiting rotation of container 124 between the first and second rotational positions.

Use of golf ball delivery system 110 to deliver a golf ball onto a golf ball tee T held by tee holder 112 is substantially the same as described above. The golfer inserts the head of a golf club within the pocket 166 and manipulates the golf club to move the delivery chute 128 to rotate container 124 between a first rotational position, illustrated in FIGS. 6 and 7, wherein the outlet hole 150 of the container and the golf ball receiving end of the delivery chute 128 are positioned to receive a golf ball from container 124 into the golf ball transporting passage of the delivery chute by gravity and a second rotational position wherein the golf ball delivering end of the delivery chute is disposed below or closer to the ground than the golf ball receiving end such that the golf ball within the passage is delivered onto the golf ball tee T by gravity from the golf ball delivering end of the delivery chute.

With the golf ball delivery system according to the present invention, the amount of time that a golfer can devote to practice is increased by eliminating the time required for the golfer to bend down and set a golf ball on a golf ball tee for each shot. The golf ball delivery system of the present invention greatly reduces golfer fatigue and strain, particularly for golfers with back problems. The golf ball delivery system can greatly enhance practice sessions for all types of golfers resulting in greater proficiency and skill. The golf ball delivery system can increase the popularity and use of practice ranges as well as increasing the number of golf balls hit at practice ranges. The various components of the golf ball delivery system can be made of various diverse materials in addition to those described herein as exemplary. With the use of a tapered container or a tilt-mounted container, golf balls are urged by gravity toward the outlet hole when the delivery chute is in the up or golf ball receiving position and are prevented from entering the outlet hole when the delivery chute is in the down or golf ball delivering position. The agitating member agitates or stirs the golf balls when the container is rotated such that a single golf ball passes through the outlet hole into the delivery chute without binding or clogging of the golf balls within the container; however, it should be appreciated that an agitating member may not be necessary. Since the delivery chute extends or protrudes slightly beyond the circumference or periphery of the end plate to which the delivery chute is attached, the golf ball passing through the outlet hole into the delivery chute drops slightly below the outlet hole when the delivery chute is in the golf ball receiving or up position such that the golf ball cannot pass back into the container. The deflector at the golf ball delivering end of the delivery chute changes the direction of travel of the golf ball causing the golf ball to drop by gravity onto the golf ball tee. The window of the container is positioned to prevent the golf balls from falling out of the container during use. The adjustable stop mechanism optimally positions the outlet hole and, therefore, the delivery chute, to receive a golf ball in the golf ball receiving position and properly positions the delivery chute relative to the golf ball tee in the golf ball delivering position for consistent, accurate delivery of a golf ball onto the tee. The golf ball delivery system can be used with various conventional golf ball tees mounted to the tee holder by the golfer thusly encouraging the golfer to inspect the golf ball tee periodically and to replace the golf ball tee as needed. The golf ball delivery system can be used equally as well by right and left handed golfers.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A golf ball delivery system comprising a tee holder adapted to support a golf ball tee upon the ground; and a golf ball dispenser coupled with said tee holder and including a container for holding a plurality of golf balls, a support rotatably mounting said container above the ground and a delivery chute attached to said container, said container having first and second ends with said second end disposed higher above the ground than said first end such that golf balls within said container gravitate toward said first end, and an outlet hole in said first end for receiving a single golf ball, said delivery chute defining a golf ball transporting passage and having a golf ball receiving end rigidly attached to said first end of said container with said outlet hole communicating with said passage and having a golf ball delivering end, said delivery chute being movable to rotate said container between a first rotational position wherein said outlet hole is positioned at a lower end of said container such that a single golf ball passes through said outlet hole and into said passage and a second rotational position wherein said golf ball receiving end is positioned at an upper end of said container and said golf ball delivering end is positioned below said golf ball receiving end in alignment with the tee holder such that the golf ball in said passage is delivered by gravity onto a golf ball tee from said golf ball delivering end of said delivery chute.

2. A golf ball delivery system as recited in claim 1 wherein said container has a longitudinal axis and said support mounts said container above the ground with said longitudinal axis disposed parallel with the ground.

3. A golf ball delivery system as recited in claim 1 wherein said container has a longitudinal axis and said support mounts said container above the ground with said longitudinal axis disposed at an angle with the ground.

4. A golf ball delivery system as recited in claim 1 wherein said container includes a longitudinal axis and further including a shaft extending through said container in alignment with said longitudinal axis and around which said container is rotatable.

5. A golf ball delivery system as recited in claim 4 wherein said support includes a base adapted to be supported on the ground and a pair of spaced uprights extending vertically from said base, said uprights supporting said shaft in spaced relation above the ground with said shaft perpendicular to said uprights.

6. A golf ball delivery system as recited in claim 5 wherein said golf ball dispenser further includes a stop mechanism for limiting rotation of said container in said first and second rotational positions.

7. A golf ball delivery system as recited in claim 6 wherein said stop mechanism is adjustable to adjust the extent to which said container is allowed to rotate between said first and second rotational positions.

8. A golf ball delivery system as recited in claim 7 wherein said delivery chute abuts said stop mechanism when said container is in said first rotational position.

9. A golf ball delivery system as recited in claim 1 wherein said container includes first and second end members at said first and second ends, respectively, said outlet hole being disposed along the periphery of said first end member.

10. A golf ball delivery system as recited in claim 9 wherein said golf ball receiving end of said delivery chute protrudes beyond said periphery of said first end member.

11. A golf ball delivery system comprising a tee holder adapted to mount a golf ball tee upon the ground; and a golf ball dispenser coupled with said tee holder and including a container for holding a plurality of golf balls, a support rotatably supporting said container horizontally above the ground and a delivery chute attached to said container, said container having first and second ends and an outlet hole in said first end for receiving a single golf ball, said first end being disposed closer to the ground than said second end such that golf balls within said container gravitate toward said first end, said delivery chute defining a golf ball transporting passage and having a golf ball receiving end rigidly attached to said first end of said container with said passage in communication with said outlet hole and having a golf ball delivering end extending beyond said container, said container being rotatable in response to pivotable movement of said delivery chute, said delivery chute being pivotable from a golf ball receiving position wherein said outlet hole and said golf ball receiving end are positioned such that a single golf ball will enter said passage from said container by gravity to a golf ball delivering position wherein said outlet hole and said golf ball receiving end are positioned such that another golf ball cannot enter said passage from said container, said golf ball receiving end is disposed higher above the ground than said golf ball delivering end and said golf ball delivering end is aligned with the tee holder such that the golf ball in said passage will be delivered onto a tee by gravity from said golf ball delivering end of said delivery chute.

12. A golf ball delivery system as recited in claim 11 and further including a deflector at said golf ball delivering end of said delivery chute for deflecting a golf ball downwardly onto the golf ball tee.

13. A golf ball delivery system as recited in claim 12 and further including a pocket on said delivery chute for receiving a head of a golf club to manually pivot said delivery chute from said golf ball receiving position to said golf ball delivering position.

14. A golf ball delivery system comprising a tee holder for being supported on the ground and adapted to hold a golf ball tee;

a golf ball dispenser coupled with said tee holder and including a container for holding a plurality of golf balls, a support for rotatably supporting said container horizontally above the ground and a delivery chute extending angularly from said container, said container having a lower end, an upper end and an outlet hole for receiving a single golf ball, said delivery chute defining a passage for transporting a golf ball and having a golf ball receiving end rigidly attached to said container with said passage in communication with said outlet hole and having a golf ball delivering end, said delivery chute being adapted for engagement by a head of a golf club to manually move said delivery chute to rotate said container, said delivery chute being movable between an up position wherein said outlet hole and said golf ball receiving end of said delivery chute are at said lower end of said container such that a golf ball in said container will pass through said outlet hole into said passage by gravity and a down position wherein said outlet hole and said golf ball receiving end of said delivery chute are at said upper end of said container such that another golf ball cannot enter said passage and said golf ball delivering end of said delivery chute is disposed below said receiving end and is aligned with the golf ball tee holder such that the golf ball in said passage is transported by gravity from said golf ball receiving end to said golf ball delivering end and is dropped onto a golf ball tee by gravity from the golf ball delivering end of the delivery chute.

15. A golf ball delivery system as recited in claim 14 wherein said support includes a pair of uprights extending perpendicularly to the ground and said container is rotatably mounted on a shaft extending perpendicularly to said uprights.

16. A golf ball delivery system as recited in claim 14 wherein said support includes a pair of uprights disposed non-perpendicularly with the ground and said container is rotatably mounted on a shaft extending perpendicularly to said uprights.

17. A golf ball dispensing system as recited in claim 14 wherein said tee holder is coupled to said container by a connecting arm connected between said support and said tee holder.

18. A golf ball delivery system as recited in claim 17 and further including an abutment mounted on said connecting arm and extending adjacent said first end of said container and a stop member on said first end of said container for engaging said abutment in said down position.

19. A golf ball delivery system as recited in claim 17 wherein said tee holder includes an upper surface spaced above the ground when said tee holder is supported thereon.

20. A golf ball delivery system as recited in claim 14 and further including an agitating member in said container for agitating golf balls therein when said container is rotated to cause a single golf ball to enter said outlet hole when said delivery chute is in said up position.

* * * * *